US006341514B2

(12) United States Patent
Engel et al.

(10) Patent No.: US 6,341,514 B2
(45) Date of Patent: Jan. 29, 2002

(54) HOLE PUNCH FOR HIGH-PRESSURE SHAPING TOOL

(75) Inventors: Bernd Engel, Burbach; Matthias Prier, Wilnsdorf, both of (DE)

(73) Assignee: Schuler Hydroforming GmbH & Co. KG, Wilnsdorf-Wilden (DE)

( * ) Notice: Subject to any disclaimer, the term of this patent is extended or adjusted under 35 U.S.C. 154(b) by 0 days.

(21) Appl. No.: 09/821,698

(22) Filed: Mar. 29, 2001

(30) Foreign Application Priority Data

Mar. 31, 2000 (DE) ..... 100 16 208

(51) Int. Cl.[7] ..... B21D 26/02; B21D 28/10
(52) U.S. Cl. ..... 72/55; 83/54
(58) Field of Search ..... 72/55, 58, 61; 83/53, 54

(56) References Cited

U.S. PATENT DOCUMENTS 3,487,668 A * 1/1970 Fuchs et al. ..... 72/55
5,460,026 A 10/1995 Schafer
5,628,220 A 5/1997 Schafer
5,765,420 A 6/1998 Schafer
5,816,089 A * 10/1998 Marando ..... 72/55
5,996,455 A * 12/1999 Haag et al. ..... 83/54
6,067,830 A * 5/2000 Klages ..... 72/55
6,098,437 A * 8/2000 Kocer et al. ..... 72/55

* cited by examiner

*Primary Examiner*—David Jones
(74) *Attorney, Agent, or Firm*—Herbert Dubno

(57) ABSTRACT

A high-pressure shaping system has a tool defining a cavity and having a bore extending along an axis and opening into the cavity which is adapted to receive a workpiece which can be internally pressurized to expand and engage against inner surfaces of the cavity. A punch extending along the axis has an axially inwardly directed inner end displaceable between an inner position generally flush with the cavity inner surface and an outer position spaced axially outward of the cavity inner surface. A spring unit braced axially inward against the punch and axially outward against the tool has a spring characteristic with a high force/displacement ratio up to a break point and a low force/displacement ratio after the break point for urging the punch inward into the inner position.

7 Claims, 2 Drawing Sheets

HOLE PUNCH FOR HIGH-PRESSURE SHAPING TOOL

FIELD OF THE INVENTION

The present invention relates to the high-pressure shaping of a hollow workpiece. More particularly this invention concerns a system for punching a hole in such a workpiece as it is being formed.

BACKGROUND OF THE INVENTION

As described in commonly owned U.S. Pat. Nos. 5,628,220 and 5,765,420 of Schafer is it known to bulge-form a workpiece, normally a metal tube, by fitting it to a die and then internally pressurizing the workpiece to such a high pressure that it is deformed outward to take the shape of the tool or die. The result is a very strong cold-formed piece whose external shape perfectly corresponds to that of the die.

It is often necessary to punch a hole in such a workpiece. Rather than do this as a separate step from outside, it is known from German 195 06 067 of Herberg and from U.S. Pat. No. 5,460,026 of Schafer to provide the shaping tool with a punch assembly comprising a guide sleeve whose inner surface is flush with an inner surface of the tool cavity and a punch fitting complementarily in the guide sleeve and movable between an inner position projecting into the tool slightly past the sleeve and an outer position recessed back in the sleeve.

During the initial shaping operation the punch is advanced slightly by an actuator to its inner position to produce an inwardly raised region of the same shape of the punch and having an outer periphery defined by a line of reduced thickness where the material of the workpiece is stretched over the edge of the punch. The punch is then retracted by its actuator and, if necessary, the pressure in the workpiece is increased to drive out the piece and cut it off at the weakened line. This procedure is extremely convenient in that it is done right in the shaping tool during the initial formation operation, and the cut-out piece ends up outside the workpiece.

The problem with this system is that it is relatively difficult to perfectly coordinate the operation of the punch with the process taking place in the tool. The punch is normally retracted when the pressure in the tool reaches a predetermined level which is calculated to correspond to when the workpiece is in solid contact with the interior face of the die cavity. It is, however, more critical that the punch be controlled in accordance with the actual position of the workpiece wall being punched out, but this is not readily ascertainable in the closed tool.

OBJECTS OF THE INVENTION

It is therefore an object of the present invention to provide an improved system for punching a hole in a workpiece being shaped by high pressure.

Another object is the provision of such an improved system for punching a hole in a workpiece being shaped by high pressure which overcomes the above-given disadvantages, that is which is quite simple and which ensures that the hole is punched when the workpiece is in the right position.

SUMMARY OF THE INVENTION

A high-pressure shaping system has according to the invention a tool defining a cavity and having a bore extending along an axis and opening into the cavity which is adapted to receive a workpiece which can be internally pressurized to expand and engage against inner surfaces of the cavity. A punch extending along the axis has an axially inwardly directed inner end displaceable between an inner position generally flush with the cavity inner surface and an outer position spaced axially outward of the cavity inner surface. A spring unit braced axially inward against the punch and axially outward against the tool has a spring characteristic with a high force/displacement ratio up to a break point and a low force/displacement ratio after the break point for urging the punch inward into the inner position.

Thus when outward pressure exerted against the punch exceeds the break point of the spring, the punch will snap outward and cause a plug of the workpiece to be pushed out into the bore of the tool and separate from the workpiece. The punch is therefore, in effect, actuated by the workpiece so it will only retract when the workpiece is bearing against it with enough force to punch out a plug from its wall by the effect of the internal pressure alone.

According to the invention the spring unit includes a mechanical spring, in particular a belleville or spring washer. Alternately it could be a knee rod, so long as it has the desired spring characteristic is obtained. With pressure plotted on the ordinate and displacement on the abscissa, the spring curve would have an initial very steep part extending almost parallel to the ordinate, then a flat part extending almost parallel to the abscissa, joined at the break point.

The punch in accordance with the invention has an outer end formed with a transversely extending abutment plate bearing on the spring washer. The tool includes a support formed with a chamber holding the abutment plate and spring washer and formed with a passage centered on the axis and through which the punch extends into the chamber. It is possible according to the invention to use an actuator having an inner end bearing on the support for moving the support axially. This actuator allows the punch to remain retracted even after relieving pressure inside the tool so the knocked-out piece stays in the bore until the workpiece has been taken out of the tool. The support has a pair of parts together forming the chamber.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
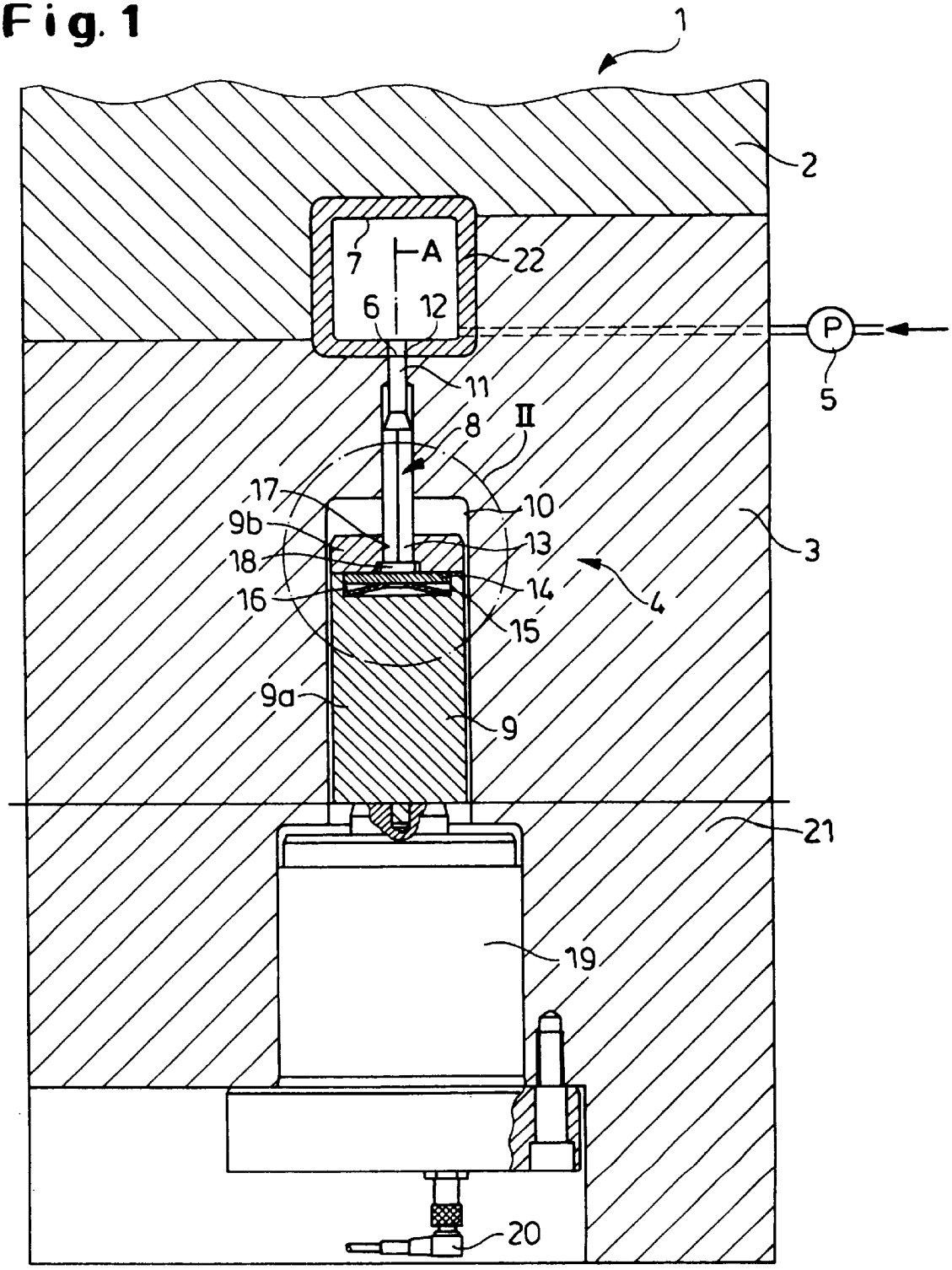
FIG. 1 is an axial section through the forming/punching system of this invention.
Figure 2:
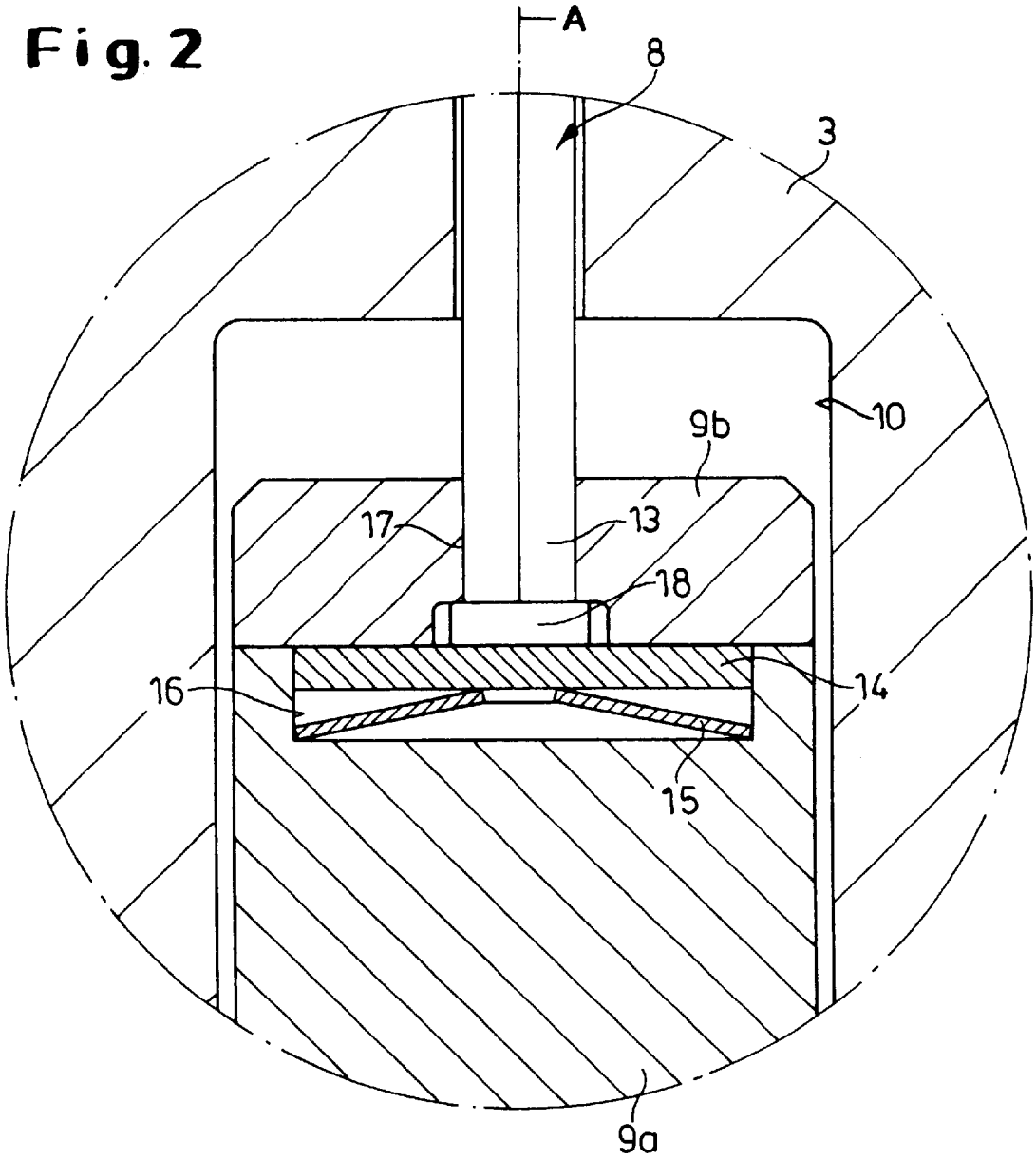
FIG. 2 is a large-scale view of the detail indicated at II in FIG. 1.

As seen in FIG. 1 a high-pressure shaping tool 1 according to the invention has an upper die half part 2 and a lower die half or part 3 together defining a cavity 22 here shown holding a hollow tubular workpiece 7. In accordance with standard practice, means such as a pump 5 introduces a fluid under very high pressure into the interior of the hollow workpiece 7 to deform it outward into engagement with the inner surfaces of the cavity 22.

According to the invention a plug or piece 6 is cut from the wall of the workpiece 7 by a device 4 having a punch 8 slidable along an axis A in the tool 1. In addition the punch

8 has a small-diameter inner end 11 received in a complementary small-diameter bore 12 in the die part 3 opening into the cavity 22 and a large-diameter rear part 13 bearing via a widened foot 18 on an abutment disk or plate 14 axially slidable in a cavity 16 formed between parts 9*a* and 9*b* of a support 9 held in a seat 10 in the tool part 3. The part 9*b* of the support 9 is formed with a cylindrical passage 17 centered on the axis A and slidably receiving the wide rear end 13 of the punch 8. The die part 3 is provided with an abutment plate 21 which may incorporate an actuator piston 19 movable along an axis A of the punch device 4 by pressure applied through a line 20. The support 9 in turn is either fixedly braced against the plate 21 or, as shown, against the actuator 19 which, when not pressurized, forms part of the die half 3.

The outer punch end 18 bears via the plate 14 and a spring or belleville washer 15 on the support 9. This spring 15 has such a spring characteristic that it does not deform substantially when stressed axially up to a certain level, termed a break point, then flattens suddenly when stressed beyond this break point, offering substantially less resistance to deformation.

Normally, as illustrated, the inner face of the punch 8 lies flush with the inner surface of the cavity 22. As the interior of the workpiece 7 is pressurized, this workpiece 7 therefore deforms outward into contact with the surface of the cavity 22 and with the end of the punch 8. Once the pressure with which the workpiece 7 bears on the punch 8 exceeds the break point of the spring 15, the spring 15 deforms and the punch 8 snaps outward. The lack of support of a defined portion of the wall of the workpiece 7 causes the piece 6 to blow out into the bore 12 and separate from the workpiece 7, leaving behind a hole that exactly conforms to the shape of the bore 12.

As pressure in the workpiece 7 is relieved, the spring 15 will push the punch 8 back inward, but since the piece 6 is already separated from the workpiece 7, the piece 6 will remain separate. Alternately after the spring 15 has been pushed past the break point, the actuator 19 can retract somewhat so that, even when pressure is relieved from the inner end of the punch 8 and the spring 15 pushes the punch 8 back in, the piece 6 will not be pushed back into the cavity 22. Only after the workpiece 7 is stripped from the die halves 2 and 3 is the actuator 19 extended to knock the piece 6 out of the bore 12.

We claim:

1. A high-pressure shaping system comprising:

a tool defining a cavity and having a bore extending along an axis and opening into the cavity, the cavity being adapted to receive a workpiece;

means for internally pressurizing the workpiece to expand it and engage it against inner surfaces of the cavity;

a punch extending along the axis and having an axially inwardly directed inner end displaceable between an inner position generally flush with the cavity inner surface and an outer position spaced axially outward of the cavity inner surface; and spring means braced axially inward against the punch and axially outward against the tool and having a spring characteristic with a high force/displacement ratio up to a break point and a low force/displacement ratio after the break point for urging the punch inward into the inner position.

2. The high-pressure shaping system defined in claim 1 wherein the spring means includes a mechanical spring.

3. The high-pressure shaping system defined in claim 1 wherein the spring means includes a spring washer.

4. The high-pressure shaping system defined in claim 3 wherein the punch has an outer end formed with a transversely extending abutment plate bearing on the spring washer.

5. The high-pressure shaping system defined in claim 4 wherein the tool includes a support formed with a chamber holding the abutment plate and spring washer and formed with a passage centered on the axis and through which the punch extends into the chamber.

6. The high-pressure shaping system defined in claim 5, further comprising actuator means having an inner end bearing on the support for moving the support axially.

7. The high-pressure shaping system defined in claim 5 wherein the support has a pair of parts together forming the chamber.

* * * * *